US009122298B2

(12) United States Patent
Kern

(10) Patent No.: US 9,122,298 B2
(45) Date of Patent: Sep. 1, 2015

(54) OPERATING DEVICE

(75) Inventor: Thorsten Alexander Kern, Alsbach (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/234,804

(22) PCT Filed: Jul. 20, 2012

(86) PCT No.: PCT/EP2012/064312
§ 371 (c)(1),
(2), (4) Date: Jan. 24, 2014

(87) PCT Pub. No.: WO2013/014087
PCT Pub. Date: Jan. 31, 2013

(65) Prior Publication Data

US 2014/0150598 A1 Jun. 5, 2014

(30) Foreign Application Priority Data

Jul. 26, 2011 (DE) ..... 10 2011 079 863

(51) Int. Cl.

| | |
|---|---|
| ***H01H 9/00*** | (2006.01) |
| ***G05G 5/03*** | (2008.04) |
| ***G05G 9/047*** | (2006.01) |
| ***G05G 1/10*** | (2006.01) |

(52) U.S. Cl.
CPC .. *G05G 5/03* (2013.01); *G05G 1/10* (2013.01); *G05G 9/047* (2013.01)

(58) Field of Classification Search
CPC ..... G05G 5/03; G05G 9/047; G05G 1/10
USPC ..... 335/205, 206; 345/161, 184; 340/407.1, 340/407.2
See application file for complete search history.

(56) References Cited

U.S. PATENT DOCUMENTS

| | | | | |
|---|---|---|---|---|
| 6,710,707 | B2 * | 3/2004 | Onodera | 340/407.1 |
| 7,834,865 | B2 * | 11/2010 | Jannasch et al. | 345/184 |
| 8,022,796 | B2 * | 9/2011 | Deininger et al. | 335/205 |
| 8,077,165 | B2 * | 12/2011 | Sakurai et al. | 345/184 |
| 2002/0097223 | A1 * | 7/2002 | Rosenberg | 345/157 |
| 2006/0012584 | A1 * | 1/2006 | Vassallo et al. | 345/184 |

FOREIGN PATENT DOCUMENTS

| | | | |
|---|---|---|---|
| CN | 1504358 | | 6/2004 |
| CN | 1646833 | | 7/2005 |
| CN | 102027268 | | 4/2011 |
| DE | 103 04 804 | A1 | 8/2003 |
| DE | 10 2006 028 228 | A1 | 12/2006 |
| DE | 10 2004 022 847 | A1 | 11/2010 |

* cited by examiner

*Primary Examiner* — Ramon Barrera
(74) *Attorney, Agent, or Firm* — Cozen O'Connor

(57) ABSTRACT

An operating device includes a handle, a sensor system and an actuator. The handle is configured to be: manually deflectable from an inoperative position relative to an axis, and rotatable about the axis, and/or displaceable axially with respect to the axis, and/or tiltable in relation to the axis, and/or displaceable transversely with respect to the axis. The sensor system is configured to detect the deflection of the handle and has a haptics device by which the handle can be subjected to the action of a haptically detectable effect in correspondence with the deflection of the handle. The actuator, to which the handle is fixedly connected, is configured to drive the handle such that the actuator can be moved alternately in one degree of freedom by a movement distance of <1 mm depending on the deflection of the handle.

10 Claims, 1 Drawing Sheet

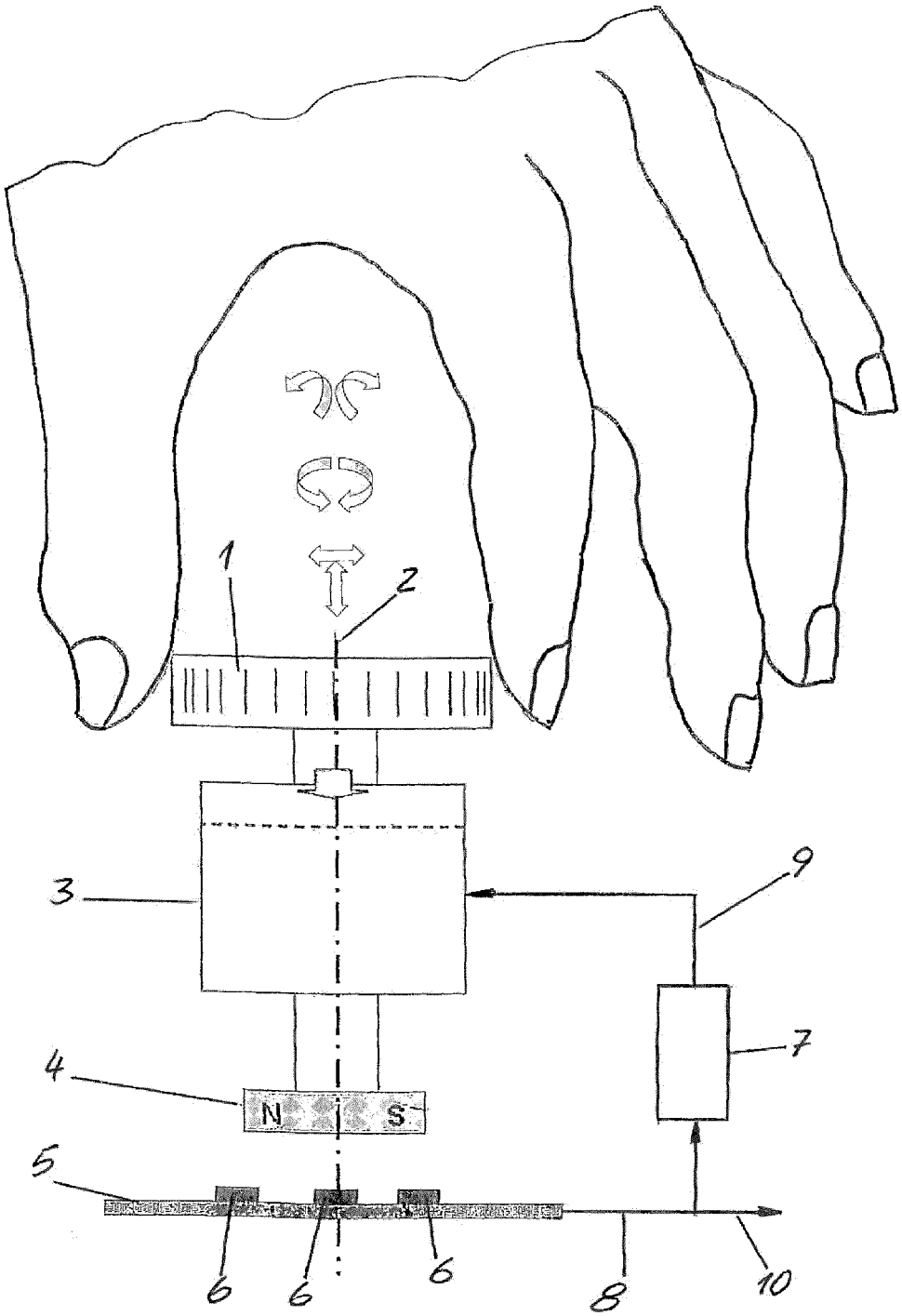
1
2
3
9
7
4
N
S
5
6
6
6
8
10

OPERATING DEVICE

CROSS-REFERENCE TO RELATED APPLICATIONS

This is a U.S. national stage of application No. PCT/EP2012/064312, filed on 20 Jul. 2012, which claims priority to the German Application No. 10 2011 079 863.3, filed 26 Jul. 2011, the content of both incorporated herein by reference.

BACKGROUND OF THE INVENTION

1. Field of the Invention

The invention relates to an operating device having a handle that can be manually deflected from an inoperative position relative to an axis, wherein the handle can be rotated about the axis and/or can be displaced axially with respect to the axis and/or can be tilted in relation to the axis and/or can be displaced transversely with respect to the axis, having a sensor system for detecting the deflection of the handle and having a haptics device by which the handle can be subjected to the action of a haptically detectable effect depending on the deflection of the handle.

2. Related Art

Operating devices of this kind are used in motor vehicles in order to control the various vehicle functionalities. In this case, the handle can be deflected with two or more types of deflection, and therefore a relatively large selection of vehicle functionalities can be actuated.

SUMMARY OF THE INVENTION

An object of the invention is to provide an operating device of the type which, given a simple design with a low overall size, allows detection of a deflection from the inoperative position and haptic feedback.

According to an aspect of the invention, this object is achieved in that the handle is fixedly connected to an actuator by which the handle can be driven such that it can be moved alternately in one degree of freedom by a movement distance of <1 mm depending on the deflection of the handle.

The handle can preferably be driven such that it can be moved alternately axially in relation to the axis.

Since a user of the operating device knows the type of deflection of the handle and it is usually not necessary to know the absolute values of the deflection of the handle, haptic feedback is provided in a simple manner for all of the types of deflection equally, so that the actuator can be of simple design and have a low overall size.

If, in this case, the handle can be driven such that it can be moved alternately in one degree of freedom at a frequency of >100 Hz, the haptics is realized in a perception frequency range in which the detection of the excitation direction of the haptics is possible only with difficulty or is not possible at all.

In order to nevertheless be able to haptically detect the type of deflection, the handle can be driven such that it can be moved alternately axially in relation to the axis with a different rhythm pattern for each type of deflection.

The handle can preferably be driven such that it can be moved alternately axially in relation to the axis by the movement distance of <0.5 mm.

Although this provides good haptic feedback, the short movement distance leads to no significant influencing of the detection of the deflection.

With a simple design that requires little installation space, the actuator can be a rotationally symmetrical reciprocating armature magnet, of which the reciprocating armature is fixedly connected to the handle and can be driven such that it can be moved alternately axially in relation to the axis by the movement distance.

In order to both return the handle to its inoperative position and also to hold the handle in this inoperative position once it has been operated, the handle can be deflected relative to the axis out of its inoperative position against a spring return force or against spring return forces.

In order to detect the deflection of the handle, electrical signals can be generated by the sensor system depending on the deflection of the handle and can be fed to a control electronics system, which can accordingly generate an actuation signal for actuating the actuator.

There is no force reaction on the handle if the deflection of the handle can be detected by a sensor system in a contact-free manner.

A long service life is also achieved as a result since there is no mechanical loading on the sensor system.

To this end, the deflection of the handle can be detected by optical sensors or by magnetic field-sensitive sensors.

To this end, in accordance with the deflection of the handle, a diametrically magnetized permanent-magnet ring can be driven in a simple manner such that it can be moved, the permanent-magnet ring being oriented in a first plane which is perpendicular to the axis and in the magnetic-field region of which a plurality of magnetic field-sensitive sensor elements are arranged in a stationary second plane which extends perpendicular to the axis when the handle is in the inoperative position.

In this case, the permanent magnet is preferably fixedly connected to the actuator or to the handle, so that a unit comprising handle, actuator and permanent magnet is formed, the unit keeping the required installation space low and simplifying assembly.

If the magnetic field-sensitive sensor elements are arranged at a uniform angular distance and a uniform radial distance from the axis when the handle is in the inoperative position, this leads to a simple design with few components and a low installation-space requirement.

The uniform angular distance is advantageous but is not absolutely necessary.

In a preferred embodiment, the magnetic field-sensitive sensor elements are Hall sensors.

In an aspect of the present invention, the line connections of the sensor elements are simplified as a result of the magnetic field-sensitive sensor elements being arranged on a printed circuit board, wherein the control electronics system can also be arranged on the printed circuit board.

BRIEF DESCRIPTION OF THE DRAWING

An exemplary embodiment of the invention is illustrated in the drawing and described in greater detail in the text that follows. In the drawing:

The FIGURE shows a schematic side view of an operating device in accordance with an exemplary embodiment.

DETAILED DESCRIPTION OF THE PRESENTLY PREFERRED EMBODIMENTS

The illustrated operating device has a handle 1 that can be deflected from its illustrated inoperative position, relative to an axis 2, with at least two of the following types of deflection.

In this case, the handle 1 can be rotated about the axis 2, can be displaced axially with respect to the axis 2, can be tilted in relation to the axis 2 and can be displaced transversely with respect to the axis 2.

An actuator 3, which has a reciprocating armature magnet (not illustrated) and a reciprocating armature, which can execute a reciprocating stroke of 0.5 mm coaxially with respect to the axis 2, is arranged coaxially on the handle 1.

A diametrically magnetized permanent-magnet ring 4 is fixedly arranged at the axial end of the actuator 3, which is averted from the handle 1.

The permanent-magnet ring 4 executes an identical deflection with respect to the axis 2 to the handle 1 owing to the fixed arrangement of the permanent-magnet ring 4 to the handle 1 by the actuator 3.

Three or more Hall sensors 6 are arranged on a printed circuit board 5, which is fixedly arranged and extends at a right angle to the axis 2, which is in the inoperative position, at a distance from the permanent-magnet ring 4, but in the magnetic-field region of the permanent-magnet ring, at the same angular distance and the same radial distance from the axis 2.

The Hall sensors 6 are connected to a control electronics system 7 by a sensor line 8 and the control electronics system 7 is connected to the actuator 3 by an actuation line 9.

Deflection of the handle 1 relative to the axis 2 produces a change in the position of the permanent-magnet ring in relation to the Hall sensors 6 and the flux densities, which are detected by the individual Hall sensors 6, change.

The signals from the Hall sensors 6, which signals are fed to the control electronics system 7, are processed in the control electronics system 7 and a corresponding actuation signal is generated, the actuation signal being fed to the actuator 3 for actuation purposes and exciting the actuator to perform an alternating movement axially in relation to the axis 2 with a reciprocating stroke of 0.5 mm and a frequency of 1.5 kHz.

This alternating movement is also transmitted to the handle 2 and detected by the user as haptic feedback.

The signals from the Hall sensors 6 are further fed to an actuation unit (not illustrated) by an output 10 for the purpose of actuating vehicle functionalities.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An operating device comprising:

a handle (1) configured to be:

manually deflectable from an inoperative position relative to an axis, and rotatable about the axis, and/or displaceable axially with respect to the axis, and/or tiltable in relation to the axis, and/or displaceable transversely with respect to the axis;

a sensor system configured to detect the deflection of the handle and having a haptics device by which the handle can be subjected to the action of a haptically detectable effect in correspondence with the deflection of the handle; and an actuator (3), to which the handle (1) is fixedly connected, configured to drive the handle (1) such that the actuator (3) can be moved alternately in one degree of freedom by a movement distance of <1 mm depending on the deflection of the handle (1).

2. The operating device as claimed in claim 1, wherein the handle (1) is configured so as to be drivable such that it can be moved alternately in one degree of freedom at a frequency of >100 Hz.

3. The operating device as claimed in claim 1, wherein the handle (1) is configured so as to be drivable such that it can be moved alternately axially in relation to the axis with a different rhythm pattern for each type of deflection.

4. The operating device as claimed in claim 1, wherein the actuator (3) comprises a rotationally symmetrical reciprocating armature magnet and reciprocating armature fixedly connected to the handle (1), the actuator being drivable such that the armature can be moved alternately axially in relation to the axis (2) by the movement distance.

5. The operating device as claimed in claim 1, further comprising a control electronics system (7), wherein the sensor system is configured to generate electrical signals in correspondence with the deflection of the handle (1) and feed the generated electrical signals to the control electronics system (7), which is configured to accordingly generate an actuation signal that actuates the actuator (3).

6. The operating device as claimed in claim 1, wherein the sensor system is configured to detect the deflection of the handle (1) in a contact-free manner.

7. The operating device as claimed in claim 6, wherein the sensor system comprises a plurality of magnetic field-sensitive sensor elements.

8. The operating device as claimed in claim 7, further comprising a diametrically magnetized permanent-magnet ring (4) drivable, in correspondence with the deflection of the handle (1), such that it can be moved, the permanent-magnet ring (4) being oriented in a first plane perpendicular to the axis (2) and in a magnetic-field region in which the plurality of magnetic field-sensitive sensor elements are arranged in a stationary second plane extending perpendicular to the axis (2) when the handle (1) is in an inoperative position.

9. The operating device as claimed in claim 8, wherein the magnetic field-sensitive sensor elements are arranged at a uniform angular distance and at the same radial distance from the axis when the handle (1) is in the inoperative position.

10. The operating device as claimed in claim 9, wherein the magnetic field-sensitive sensor elements are Hall sensors (6).

* * * * *